US005197891A

United States Patent [19]

Tanigawa et al.

[11] Patent Number: 5,197,891

[45] Date of Patent: Mar. 30, 1993

[54] THROUGH BOARD SURFACE MOUNTED CONNECTOR

[75] Inventors: Junichi Tanigawa, Kawasaki; Shoji Kikuchi, Hiratsuka, both of Japan

[73] Assignee: AMP Incorporated, Harrisburg, Pa.

[21] Appl. No.: 884,092

[22] Filed: May 15, 1992

[30] Foreign Application Priority Data

Jun. 14, 1991 [JP] Japan ..... 3-53173

[51] Int. Cl.[5] ..... H01R 9/09

[52] U.S. Cl. ..... 439/83

[58] Field of Search ..... 439/55, 78, 79, 80, 439/83; 228/180.2

[56] References Cited

U.S. PATENT DOCUMENTS

| | | | |
|---|---|---|---|
| 4,645,279 | 2/1987 | Grabbe et al. | 439/862 |
| 4,750,889 | 6/1988 | Ignasiak et al. | 439/83 |
| 4,917,614 | 4/1990 | Kikuchi et al. | 439/83 |
| 4,948,030 | 8/1990 | Chason et al. | 228/180.2 |
| 5,030,107 | 7/1991 | Moon | 439/62 |

FOREIGN PATENT DOCUMENTS

| | | | |
|---|---|---|---|
| 2-90481 | 3/1990 | Japan | 439/78 |
| 3-44995 | 2/1991 | Japan | 439/78 |
| 3-79170 | 8/1991 | Japan . | |
| 2022337 | 12/1979 | United Kingdom . | |

OTHER PUBLICATIONS

Research Disclosure No. 269, Sep. 1986, Havant GB p. 516, "Molded Stackable Surface Mounted Connector".

*Primary Examiner*—Neil Abrams

*Attorney, Agent, or Firm*—Adrian J. LaRue; Timothy J. Aberle

[57] ABSTRACT

An electrical connector (10) includes a plastic housing (12) of a configuration to fit through an aperture (32) of a printed circuit board (30) having circuits (34) on the undersurface (33) thereof with the connector housing having wing portions (14) carrying contact portions (26) adapted to engage the circuits of the underside of the printed circuit board and be soldered thereto to minimize the overall height of the assembly formed of the connector and board.

10 Claims, 2 Drawing Sheets

THROUGH BOARD SURFACE MOUNTED CONNECTOR

FIELD OF THE INVENTION

This invention relates to an electrical connector of a type adapted to extend through a printed circuit board and be interconnected to circuits on the lower surface of such board.

BACKGROUND OF THE INVENTION

Surface mount technology (SMT) has evolved utilizing printed circuit boards having circuits printed or etched out in conductive foil on the surfaces thereof to define circuit traces that extend to and from board mounted components and connectors leading to and from the board. SMT has led to a widespread packaging technique for a host of applications including consumer electronics of a type demanding high density packaging. With SMT, components and connectors are mounted on the surface of the board with a solder cream either applied to contacts of the connector or to the board itself, and with an appropriate flux applied, and the solder heated and caused to be reflowed to effectively solder contacts of connectors and components to circuits on the board surface. U.S. Pat. No. 4,917,614 discloses such an SMT connector. SMT contrasts with earlier developed techniques wherein printed circuit boards contained holes with connectors and components having contacts with pins that were fitted in such holes with soldering to the printed circuit board occurring either on the bottom or within the holes by a suitable solder reflow. Typically, component and connector contacts are coated with a tin or tin lead material, compatible with the use of solder creams and/or reflowable in and of itself.

With certain consumer appliances and devices, such as cameras, camcorders, and the like, weight and volume become important, and the overall height and volume of an installed component and/or connector and a printed circuit board can become critical.

Accordingly, it is an object of the present invention to provide an electrical connector for use with a printed circuit board that allows a use of SMT with a reduced height and volume of the connector and printed circuit board for improved packaging. It is still a further object to provide an electrical connector having a housing and contacts oriented to maximize center-to-center spacing, and at the same time, facilitate soldering of such contacts to conventionally oriented circuit traces on printed circuit boards.

It is yet a further object to provide an improved SMT connector and a method of application to a printed circuit board.

SUMMARY OF THE INVENTION

The present invention achieves the foregoing objectives through the provision of an electrical connector having a plastic housing containing electrical contacts therein with the housing and contacts having a configuration to fit through an aperture in a printed circuit board and extend above and beneath the board upper and lower surfaces. The contacts include first portions oriented perpendicularly to the board surface and adapted to interconnect with the contacts of a mating connector and second portions that extend generally in a plane parallel to that of the printed circuit board with upper surfaces that engage circuits carried on the lower surface of the board. In this way, the overall height of board and connector is reduced by the thickness of the board through which the connector housing is fitted. This contrasts with conventional mounting of connectors on printed circuit boards for employing SMT; conventional connectors being rested on the upper surface of a printed circuit board with contacts having portions parallel to such surface and with reflow occurring on such surface between circuits thereon and the contact portions that rest on such circuits, the thickness of the assembly including the overall height of the connector and contacts and the thickness of the printed circuit board. With sizes of connectors frequently having dimensions wherein the height of the connector is 0.250 inches and boards are on the order of 0.063 inches in thickness, the improvement represented by the invention can be appreciated as significant.

The contacts of the invention connector are stamped and formed of thin, flat metal stock, preferably of a spring grade and hardness to allow for the provision of a resilient contact, provided in the upper portion of the contact. In accordance with the invention, the upper portions of the contacts are formed to extend in a row or rows and parallel to an axis oblique to the length axis of the housing. This facilitates an improvement in density of contacts facing by reducing the effective width of the contacts in the housing. The contacts each include lower portions that extend at right angles to the length axis of the housing so as to be conventionally oriented relative to standard X and Y patterns of pads and traces on printed circuit boards. Contacts are set on edge to further minimize the allowable center-to-center spacing of such contacts in such housing. The upper surfaces of the second portions of the contacts are rounded to facilitate soldering to circuits on the underside surface of the printed circuit board.

The foregoing is implemented through a method of assembly and construction of connector and printed circuit board.

BRIEF DESCRIPTION OF THE DRAWINGS

The invention will now be described by way of example with reference to the accompanying drawings in which.

DETAILED DESCRIPTION OF THE INVENTION

Figure 1:
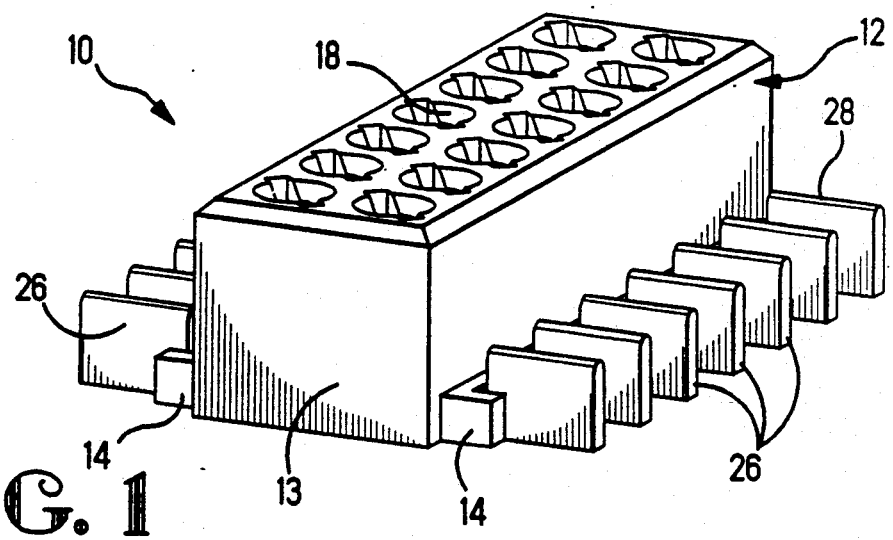
FIG. 1 is a perspective view of an electrical connector in accordance with the invention.
Figure 2:
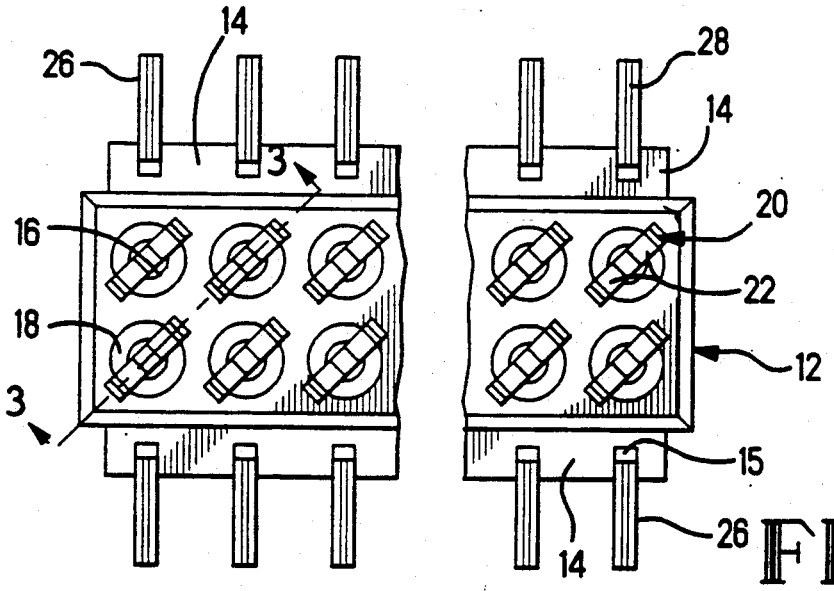
FIG. 2 is a partial plan view of the connector shown in FIG. 1.
Figure 3:
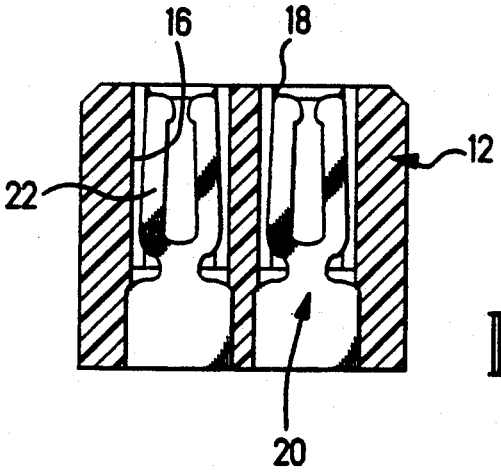
FIG. 3 is a side view taken through lines 3—3 of FIG. 2.
Figure 4:
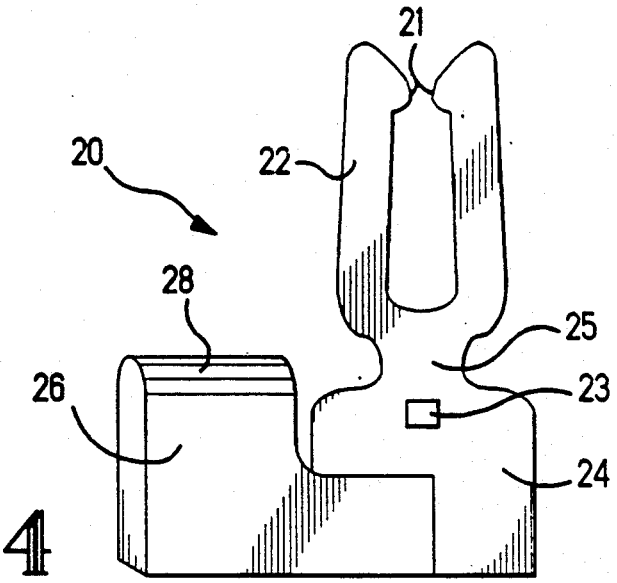
FIG. 4 is a side, elevational view of a contact of the invention.

Referring now to FIG. 1, an electrical connector 10 of the SMT variety is shown to include a plastic housing 12 that has an upper portion 13 and a lower portion 14 in the form of wings that extend transversely of the housing 12. To be noted in FIG. 1, through the direction of the arrow thereshown, the mating axis with connector 10 is parallel to the height of the housing and transverse to the extension of projections 14. A mating connector, not shown, would be utilized to engage connector 10 and interconnect such connector to further circuits such as printed circuit boards or flexible circuits, or wires and cables. Housing 12 would typically be molded of an engineering plastic having suitable dielectric quality characteristics. Housing 12 includes, as is shown in FIG. 2, a series of apertures 16 that extend through the height of the housing. Bevels 18, as shown in FIGS. 2 and 3, guide post or pin portions of a mating connector to extend within the housing and engage contacts 20 therewithin. The contacts 20, as shown in FIGS. 2 and 3, are bifurcated to include a U-shaped portion 22 having interiorly rounded surfaces 21, shown in FIG. 4, with the surfaces 21 engaging post or pins of mating connectors and the arms 22 operating to provide a normal spring force adequate to ensure a low-resistance, stable electrical interface with such mating pin portions. Also shown in FIG. 4, the contacts 20 include a projection 23 that projects sideways to latch or lock the contacts within the housing by engaging internal surfaces of the housing not shown. The contacts have a base portion 24 and a narrowed neck portion 25 joining the upper portion 22. The neck portion 25 serves to facilitate slight movements caused by tolerance variations with respect to the contacts 20 and mating contacts. Extending from the base portion 24 is a lower contact portion 26 having a rounded upper surface 28, the upper surfaces of the second portions of the contacts are rounded to facilitate soldering to circuits on the underside surface of the printed circuit board, the portion 26 extending out from base portion at an angle in the manner shown in FIG. 2 relative to upper portion 22. Portions 26 extend through slots 15 in the wing portions 14 of housing 12. As can be seen from FIG. 1, portions 26 extend above the projecting portions 14 of housing 12 so that rounded, or tapered, surfaces 28 extend in a parallel plane.

Figure 5:
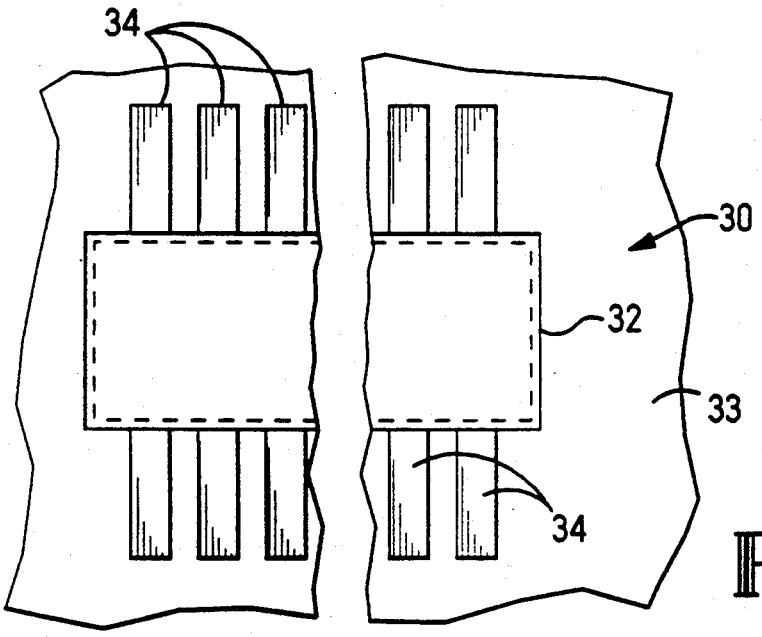
FIG. 5 is a plan view of a printed circuit board from the underside, showing circuits thereon and an aperture therein.
Figure 6:
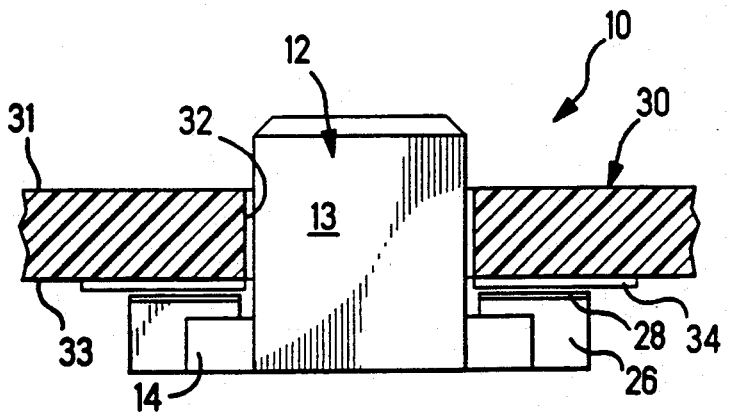
FIG. 6 is a side, elevational, and partially sectioned view showing the connector of the invention installed in a printed circuit board aperture.

Referring now to FIG. 5, a printed circuit board 30 is shown to include an aperture 32 extending therethrough with circuit pads 34 extended on the lower surface of the board 30, note FIG. 6, outward from the edge surfaces of aperture 32. The cross-sectional profile of housing 12 of the connector is shown in phantom in FIG. 5. Pads 34 are to be understood to be connected to further circuit traces within board 30 or on the opposite sides thereof that extend to interconnect to components or other connectors or the like. To be noted is the orientation of pads 34 transverse to the length axis of aperture 32 and therefore to the length axis of housing 12 as mounted within the aperture. The provision of the bulk of circuit traces and pads on printed circuit boards along conventional X and Y axes is thus accommodated by the arrangement of traces as shown in FIG. 5. To be also noted is the orientation of portions 26, oriented in a conventional manner, transverse to the length axis of the housing 12 and to the length axis of the aperture 32. On the other hand, the contacts 20, the upper portions thereof, are oriented obliquely to such axis. This facilitates a stacking in side-by-side relationship that accommodates a closer center-to-center spacing, both in a sense relative to the width of the housing 12 or in relation to the length of the housing.

As can be discerned from FIG. 6, the printed circuit board 30 includes an upper surface 31 and a lower surface 33 interconnected by aperture 32 with circuit pads 34 formed on the undersurface 33. Connector 10 is made to fit within the aperture, the upper portion 13 extending up through the aperture above the surface 31 and wing portions 14 carrying portions 26 of the contacts extending beneath the surface 33 to allow the upper surfaces 28 to engage pads 34 and be soldered thereto by a reflowing of solder cream applied either to the contacts or to the pads. Fastening means can be used to secure the connector to the circuit board prior to soldering contact portions 26 to pads 34, if desired.

The invention contemplates an alternative potential use of the connector of the invention by extending the contact portions 26 below or beneath the portions 14. In such alternate embodiment, the connector 10 could be placed on the top surface of board 30 and soldered thereto with the contact portions 26 resting on such surface and on pads thereon. In this manner, the same connector could be employed in certain areas on printed circuit boards to minimize overall package height and in other areas, placed on top of the board for configuration considerations; as for example, along an edge of the board to provide an I/0 function. The bottom surfaces of portions 26 would be preferably rounded.

The present invention thus provides an SMT connector that takes advantage of height by extending through the thickness of the board to reduce the overall packaging height required and through the provision of the contacts, and orientation thereof maximizes a density of contacts in terms of center-to-center spacing.

Accordingly, claims are attached to define what is inventive.

We claim:

1. An electrical connector for mounting in an aperture of a circuit board, comprising:

a dielectric housing having a main body portion with a substantially flat bottom surface, an upper section for being disposed within the aperture of the circuit board so as to extend above the upper surface thereof, and a lower section having a substantially flat bottom surface extending outwardly from at least one side of said housing;

electrical contacts secured in contact-receiving passageways of said housing including contact sections located in said upper section and termination sections disposed in said housing lower section, said termination sections having a substantially flat bottom surface, and further having upper exposed surfaces for electrical connection to circuit pads disposed along the lower surface of the circuit board adjacent the aperture; and wherein said main body, said housing lower section, and said termination sections bottom surfaces are in substantial flush alignment across the surfaces thereof, thereby permitting close stacking of a plurality of said circuit boards.

2. An electrical connector as claimed in claim 1, wherein said upper exposed surfaces of said termination sections are rounded or tapered.

3. An electrical connector as claimed in claim 1, wherein said bottom surfaces of said termination sections are exposed.

4. An electrical connector as claimed in claim 1, wherein said contact sections are U-shaped.

5. An electrical connector as claimed in claim 1, wherein said contact-receiving passageways extend through said housing from said main body bottom surface to an upper surface and are disposed at an acute angle with respect to a set of substantially flat side and end surfaces of said housing, said contact sections including base sections thereof being secured in said contact-receiving passageways, said termination sections extending outside of said lower section of the housing at a substantially right angle with respect to the side surface of the housing from which they extend due to said termination sections extending from said base sections at an acute angle with respect to the plane of the contact and base sections.

6. An electrical connector for mounting in an aperture of a circuit board, comprising:

a dielectric housing having a main body portion with a substantially flat bottom surface, an upper section means for being disposed within the aperture of the circuit board so as to extend above the upper surface thereof;

electrical contacts secured in contact-receiving passageways of said housing including contact sections located in said upper section means and outwardly projecting termination sections adjacent to said housing bottom surface, said termination sections having a substantially flat bottom surface, and further having upper exposed surface means for non through-hole type electrical connection to circuit pads disposed along the lower surface of the circuit board adjacent the aperture; and wherein said main body and said termination sections bottom surfaces are in substantial flush alignment across the surfaces thereof, thereby permitting close stacking of a plurality of said circuit boards.

7. An electrical connector as claimed in claim 6, wherein said upper exposed surace means of said termination sections are rounded or tapered.

8. An electrical connector as claimed in claim 6, wherein said bottom surfaces of said termination sections are exposed.

9. An electrical connector as claimed in claim 6, wherein said contact sections are U-shaped.

10. An electrical connector as claimed in claim 6, wherein said contact-receiving passageways extend through said housing from said main body bottom surface to an upper surface and are disposed at an acute angle with respect to a set of substantially flat side and end surfaces of said housing, said contact sections including base sections thereof being secured in said contact-receiving passageways, said termination sections extending outside of the housing at a substantially right angle with respect to the side surface of the housing from which they extend due to said termination sections extending from said base sections at an acute angle with respect to the plane of the contact and base sections.

* * * * *